United States Patent [19]

Seki

[11] 4,015,436

[45] Apr. 5, 1977

[54] METHOD FOR CONTROLLING THE CAPACITY OF A BLOWER AND A DEVICE FOR CONTROLLING THE PRESSURE IN A LIQUEFIED GAS STORAGE TANK UTILIZING SAID METHOD

[75] Inventor: Masao Seki, Tokyo, Japan

[73] Assignee: Tokyo Gas Company Limited, Tokyo, Japan

[22] Filed: July 30, 1975

[21] Appl. No.: 600,482

[52] U.S. Cl. ..... 62/48; 48/191; 62/50; 137/4; 137/91; 417/302; 417/901

[51] Int. Cl.[2] ..... F17C 7/02

[58] Field of Search ..... 62/45, 48, 50, 51, 52, 62/53, 54, 55; 417/901, 302; 137/91, 4; 48/190, 191

[56] References Cited

UNITED STATES PATENTS

| | | | |
|---|---|---|---|
| 3,121,999 | 2/1964 | Kasbohm et al. | 62/48 |
| 3,369,371 | 2/1968 | Holly et al. | 62/54 |
| 3,689,237 | 9/1972 | Stark et al. | 48/190 |
| 3,690,115 | 9/1972 | Clayton | 62/55 X |
| 3,771,260 | 11/1973 | Arenson | 48/190 |

*Primary Examiner*—Ronald C. Capossela
*Attorney, Agent, or Firm*—Wenderoth, Lind & Ponack

[57] ABSTRACT

A method of controlling the capacity of a gas blower for pumping gas at a given discharge pressure involving cooling the gas at the suction side of the blower. The method is especially useful for controlling the pressure in a liquefied gas storage tank so as to maintain it substantially constant. The boil-off gas in the tank is exhausted by a gas blower and liquefied gas is injected into the boil-off gas exhausted from the tank at a point on the suction side of the blower for cooling the boil-off gas exhausted from the tank prior to its being pumped by the blower. The amount of liquefied gas injected into the boil-off gas is proportional to the pressure of the boil-off gas in the storage tank. The apparatus for the control includes a temperature controller coupled between a control valve controlling the injection of liquefied gas and the gas discharging tube on the suction side of said blower for opening the control valve according to the difference between a set temperature and a sensed temperature, and a pressure controller coupled between the temperature controller and the gas discharging tube adjacent the storage tank for sensing the pressure of gas in the tank and setting the temperature of the temperature controller at which the temperature controller actuates the control valve according to the pressure in the storage tank.

2 Claims, 2 Drawing Figures

METHOD FOR CONTROLLING THE CAPACITY OF A BLOWER AND A DEVICE FOR CONTROLLING THE PRESSURE IN A LIQUEFIED GAS STORAGE TANK UTILIZING SAID METHOD

This invention relates to a method for controlling the capacity of a blower, and further relates to a device for controlling the pressure in a liquefied gas storage tank utilizing said controlling method.

BACKGROUND OF THE INVENTION AND PRIOR ART

The methods usually used for controlling the capacity of a blower are (a) to control the rate of rotation of the blower, (b) to provide a control valve on either the discharge side or the suction side of a blower and to control the capacity by adjusting the valve, and (c) to control the capacity by returning part of the gas from the discharge side to the suction side. In (a) the control mechanism is complicated; in (b) power is wasted when the valve on the discharge side is used for the control and there is a danger of surging. Further, when the valve on the suction side is used for control, power is also wasted and also there is a danger that the pressure on the suction side will become negative. In (c) much power is wasted.

OBJECTS AND BRIEF SUMMARY OF THE INVENTION

It is therefore an object of the present invention to provide a method of controlling the capacity of a blower which overcomes the drawbacks of the methods described above and which is simple and effective.

It is a further object of the invention to provide a system for controlling the pressure in a liquefied gas storage tank utilizing the method of the present invention.

These objects are acheived by a method in which the capacity of a blower is controlled by cooling the gas supplied to the suction side of the blower, while maintaining the discharge pressure substantially constant, whereby the capacity of the blower is increased. This method is utilized for controlling the pressure in a liquefied gas storage tank so as to keep the pressure substantially constant by injecting liquefied gas into the gas from the storage tank to cool the storage tank gas at the suction side of the blower for discharging the gas from the storage tank, and controlling the temperature at which the valve means for controlling the amount of liquefied gas injected is operative inversely to the pressure in the storage tank, whereby the greater the pressure in the tank, the more liquefied gas is injected into the gas being discharged from the tank and the more the capacity of the blower is increased.

BRIEF DESCRIPTION OF THE DRAWINGS

The invention will now be described in greater detail in connection with the accompanying drawings, in which:

Referring to FIG. 2, a blower 1 pumps a given amount of gas. If the gas on the suction side P of the blower 1 is cooled, the density of the gas increases as a result of the cooling which in turn results in increasing the capacity of the blower. FIG. 1 shows measurements of the capacity of the blower 1, using as a parameter the gas temperature on the suction side P. As seen in FIG. 1, when the discharge pressure is kept constant, the capacity is greatly increased by cooling the gas on the suction side P. Consequently, the capacity of the blower 1 can be readily and stably controlled by cooling the temperature of the gas on the suction side P.

The gas can be cooled by any well-known method. For example, when discharging boil-off gas in a liquefied gas storage tank, the boil-off gas can be cooled by being caused to give up latent heat of vaporization of liquefied gas.

Figure 2:
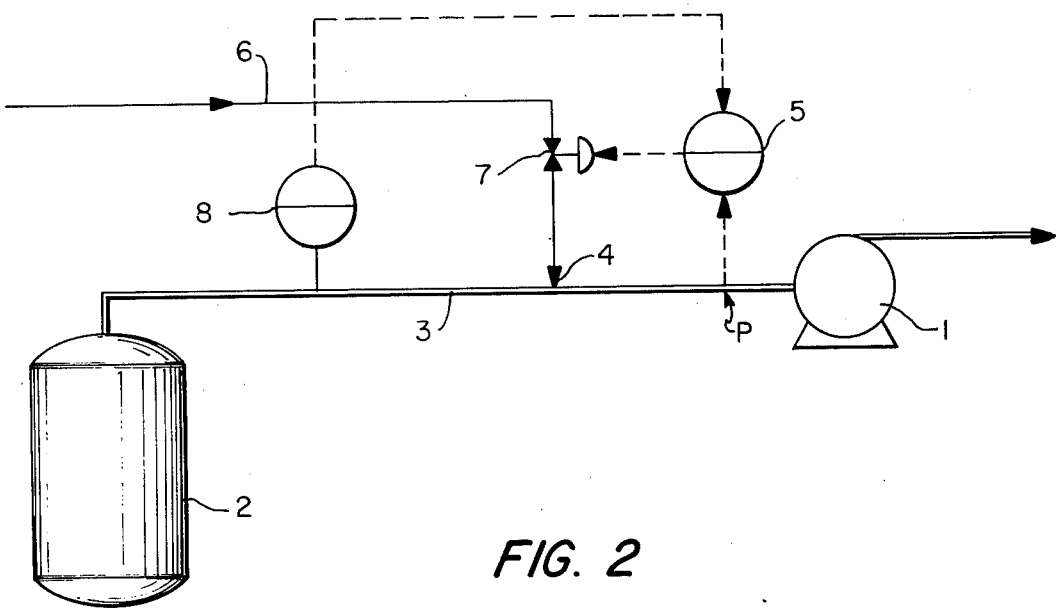
FIG. 2 is a schematic diagram of a system for controlling the gas pressure in a storage tank for liquefied gas according to the invention.

The method for controlling the capacity of a blower according to this invention can be utilized to construct a simple device for controlling the pressure in a liquefied gas storage tank. An example of such a device is shown in FIG. 2.

A liquefied gas storage tank 2 is connected to the blower 1 by a boil-off gas discharging tube 3, and the boil-off gas which has vaporized spontaneously from the liquefied gas in the tank 2 is discharged through the tube 3 by suction of the blower 1. The discharging tube 3 is provided with an injection means 4 for injecting liquefied gas supplied through injection tube 6 from a source of liquefied gas (not shown). The amount of the liquefied gas injected by the said injection means 4 is controlled by adjusting the valve 7 provided in the injection tube 6 by a temperature controller 5 coupled to the suction side of the blower 1 for detecting the temperature of boil-off gas at the suction side of the blower 1. The temperature at which the temperature controller 5 is set to actuate valve 7 is controlled by the pressure controller 8 coupled to the tube 3 for detecting the pressure in the said tank 2, the temperature being lower as the tank pressure increases, i.e. varying inversely as the tank pressure. In this system, as the boil-off gas in the tank 2 is discharged by the blower 1 through the discharging tube 3, the temperature controller 5 detects the temperature of the boil-off gas at the suction side P of the blower 1, and controls the valve 7. When valve 7 is opened in response to actuation by controller 5, liquefied gas is injected into the discharging tube 3 through the injection tube 6 and means 4, and cools the boil-off gas by taking out of the gas the latent heat of vaporization of the liquefied gas. Since the temperature at which the temperature controller 5 is set to operate is controlled by the pressure controller 8 which detects the pressure in the tank 2, the boil-off gas is cooled to a greater degree as the pressure in the tank 2 increases, so that the capacity of the blower 1 is increased with an increase in tank pressure by a reduction of the temperature of the boil-off gas. The pressure in the tank 2 can thus be kept constant.

Figure 1:
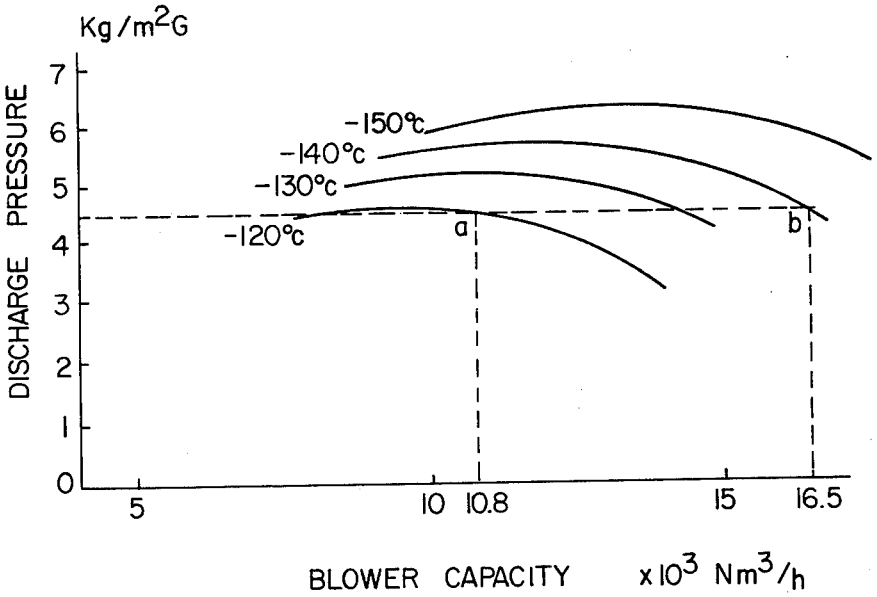
FIG. 1 is a graph showing the blower capacity at various temperatures of the gas on the suction side thereof.

As an example, control of the discharge of boil-off gas from an LNG (Liquefied Natural Gas) tank by a turbo-type blower will be described. When the boil-off gas is not cooled, the amount of the boil-off gas discharged by the blower 1 is 10,800 $Nm^3/h$, when the temperature of the blower 1 inlet is −120° C and the discharging pressure is $4.5 kg/cm^2G$, as shown in FIG. 1 with a dotted line. When the boil-off gas is cooled to −140° C, the amount of the boil-off gas which can be discharged can be obtained as follows.

The required amount (S) of LNG to be injected by the injection means 4 for cooling 1 gram of the boil-off gas at −120° C (100% methane gas) with LNG, for example, at −150° C, for example to −140° C, is calculated by the following equation: the average specific heat of boil-off gas at −120° C ~ −140° C is 0.43 cal/g° C, and the latent heat of LNG at −150° C is 120 cal/g (neglecting the sensible heat from −150° C to −140° C).

$$S = \frac{\{-120^\circ\,C - (-140^\circ\,C)\} \times 0.43 cal/g^\circ\,c \times lg}{120\ cal/g} = 0.072g$$

Thus, the amount of the boil-off discharged by the blower 1 (i.e. the sum of the boil-off gas from the tank 2 and the gas due to LNG injection) increases as compared to the amount of the boil-off gas by 7.2%. However, when the temperature of the boil-off gas is reduced from −120° C to −140° C, the capacity of the blower 1 increases from 10,800Nm³/h(−120° C, the point *a* in FIG. 1) to 16,500Nm³/h(−140° C, the point *b* in FIG. 1, assuming the discharge pressure remains 4.5kg/cm²G. The 16,500 Nm³/h of gas is the sum of the boil-off gas in the tank 2 and the gas which is injected and vaporized. The amount of the boil-off gas in the sum is 15,390Nm³/h according to the following equation:

$$16{,}500Nm^3/h \times \frac{1}{1.072} = 15{,}390Nm^3/h$$

This means that if the amount of the boil-off gas increases from 10,800Nm³/h to 15,390Nm³/h, the elevation of the pressure in the tank 2 corresponding to the increase of the amount of the boil-off gas is detected by the pressure controller 8, which sets the operating temperature of controller 5 to control the valve 7 at a temperature such that an adequate amount of LNG is injected to reduce the temperature of the boil-off gas from −120° C to −140° C. Accordingly, the amount of the boil-off gas discharged from the tank 2 increases from 10,800Nm³/h to 15,390Nm³/h to keep the pressure in the tank 2 constant.

According to the present invention, the gas to be discharged by a blower is cooled on the suction side of the blower to control the amount discharged by the blower. Thus, the present invention is quite different from the conventional method for controlling the amount discharged and has excellent advantages which can overcome the defects of the conventional methods described hereinbefore. The invention also provides a device for controlling the pressure in a liquefied gas storage tank which utilizes the method for control of the amount of discharge from a blower, which device has a simple structure and can provide sure, stable control.

What is claimed is:

1. An apparatus for controlling the pressure in a liquefied gas storage tank so as to maintain it substantially constant, comprising a gas blower, a boil-off gas discharging tube connected between the storage tank and said blower, liquefied gas injection means in said boil-off gas discharging tube on the suction side of said blower, a control valve in said injection means, a temperature controller coupled between said control valve and said gas discharging tube on the suction side of said blower for opening said control valve according to the difference between a set temperature and a sensed temperature and a pressure controller coupled between said temperature controller and said gas discharging tube adjacent said storage tank for sensing the pressure of gas in said tank and setting the temperature of said temperature controller at which said temperature controller actuates said control valve according to the pressure in said storage tank.

2. A method of controlling the pressure in a liquefied gas storage tank so as to maintain it substantially constant comprising exhausting the boil-off gas in the liquid storage tank by a gas blower, injecting a non-absorbant liquefied gas into the gas exhausted from the liquefied gas storage tank at a point on the suction side of the blower, cooling the boil-off gas exhausted from the tank prior to its being pumped by the blower, and controlling the amount of liquefied gas injected into the boil-off gas proportionally to the pressure of the boil-off gas in the storage tank.

* * * * *